US005964546A

United States Patent [19]

Castaño

[11] Patent Number: 5,964,546

[45] Date of Patent: Oct. 12, 1999

[54] SPLIT SEPARABLE JOINT APPARATUS AND METHOD

[75] Inventor: Francisco Castaño, Houston, Tex.

[73] Assignee: Geometrica, Inc., Houston, Tex.

[21] Appl. No.: 08/897,491

[22] Filed: Jul. 21, 1997

[51] Int. Cl.[6] ..... F16B 17/00

[52] U.S. Cl. ..... 403/344; 403/174; 403/217; 52/646

[58] Field of Search ..... 403/217, 218, 403/219, 171, 176, 170, 175, 174, 178, 334, 339, 344; 52/646, 648.1, 655.1

[56] References Cited

U.S. PATENT DOCUMENTS

| | | | |
|---|---|---|---|
| 2,895,753 | 7/1959 | Fentiman . | |
| 2,916,109 | 12/1959 | Fentiman . | |
| 2,931,467 | 4/1960 | Fentiman . | |
| 2,964,147 | 12/1960 | Fentiman . | |
| 2,976,968 | 3/1961 | Fentiman . | |
| 3,079,681 | 3/1963 | Fentiman . | |
| 3,081,601 | 3/1963 | Fentimen . | |
| 3,152,819 | 10/1964 | Fentiman . | |
| 3,275,351 | 9/1966 | Fentiman . | |
| 3,309,121 | 3/1967 | Fentiman . | |
| 3,563,581 | 2/1971 | Sommerstein | 403/217 |
| 4,353,662 | 10/1982 | Du Chateau | 403/171 |
| 4,606,669 | 8/1986 | DeBliquy | 403/218 X |
| 4,838,003 | 6/1989 | Zeigler | 403/171 X |
| 4,951,440 | 8/1990 | Staeger | 403/171 X |
| 5,102,254 | 4/1992 | Yeh | 403/174 |
| 5,626,434 | 5/1997 | Cook | 403/176 |

FOREIGN PATENT DOCUMENTS

| | | | |
|---|---|---|---|
| 2759895 | 2/1990 | Germany | 403/171 |
| 619609 | 8/1978 | U.S.S.R. | 403/217 |
| 1392220 | 4/1988 | U.S.S.R. | 403/171 |
| 1414936 | 8/1988 | U.S.S.R. | 403/171 |
| 1477867 | 5/1989 | U.S.S.R. | 403/170 |

*Primary Examiner*—Harry C. Kim
*Attorney, Agent, or Firm*—Haynes and Boone, L.L.P.

[57] ABSTRACT

A split separable joint includes a cylindrical hub having a first portion and a second portion. The hub portions interconnect at a keyed interface. The hub has axially extending, radially directed, keyed slots formed in a peripheral hub surface for receiving structural members. The first and second hub portions are retained together as a unit by a fastener which extends diametrically through aligned bores in each hub portion. The structural members are retained in place by an axially extending fastener which retains end plates on opposed ends of the hub.

24 Claims, 6 Drawing Sheets

SPLIT SEPARABLE JOINT APPARATUS AND METHOD

BACKGROUND

The disclosures herein relate generally to space frame joint, and more particularly to a method and apparatus for interconnecting tubular frame members by means of a split separable joint.

Separable joints, such as those used in space frame construction are generally a cylindrical hub which includes a plurality of radially directed slots extending axially along the circumferential surface of the hub. The slots have opposed surfaces facing each other which are ribbed. The ribs extend axially along the opposed surfaces.

Tubular frame members are flattened and crimped at their opposed ends. The crimped ends include elongated flat surfaces extending outwardly, or away from each other. The crimped ends are ribbed in a pattern which can be mated into engagement with the ribs in the hub slots. In this manner, each end of a tubular frame member may be slidably inserted into a respective hub slot and several tubular frame members may be connected at one end to a hub slot to form a spider, i.e., a hub having a plurality of tubes extending radially outwardly therefrom, each tube terminating at a free end.

The free end of each tube can be similarly connected to another hub. Thus, a framework of interconnected spiders formed of tubes and hubs can be joined to form a pre-assembled or modular section of a flat roof, a domed roof, a wall, etc., to be joined with other sections to eventually form a complete structure. The structure, once completed, is then covered with a selected cladding which is attached to the structural framework by means of an interfacing cladding support system. The cladding may be fabric, corrugated steel plates, glass, and other selected materials and may include combinations of these materials for architectural design purposes. For example, a domed roof may be clad with steel and may include a pattern of glass panels in a portion of the roof which has an aesthetic effect when viewed from the interior of the structure.

Joining the pre-assembled sections of the framework is difficult and time-consuming. Each section has a periphery including a plurality of hubs. These hubs are connected to their respective section by tube members as mentioned above. When sections are to be joined, additional members of tubing have one end connected to the peripheral hubs of one section, and have their opposite ends connected to the peripheral hubs of an adjoining section. Because the modular sections are often quite large, e.g., 50 feet square, they must be hoisted into their approximate position, suspended by a crane and then a few of the additional members of tubing must be individually and manually aligned with and inserted into the peripheral hubs to stabilize the hoisted section relative to the section of framework to which the hoisted section is being attached. Once stabilized, additional members of tubing are used to complete the interconnection of the hoisted section into the framework.

Due to the large size of the hoisted, suspended section, and the multi-directional movement of the section while suspended in space, manual insertion of the tube ends into the hub slots is labor-intensive and thus costly. This adds undesirable construction time and cost to each job.

Therefore, what is needed is an apparatus and a method of interconnecting space frame sections which overcomes the alignment problems associated with attaching one end of the tube members to a suspended, modular frame section and then attaching the opposite end of the tube members to the framework which is in place, and which can be accomplished in a facilitated manner which reduces alignment and assembly difficulties associated with present construction techniques and thus reduces construction time and cost.

SUMMARY

One embodiment accordingly, provides an apparatus and a method of interconnecting space frame sections in a manner which facilitates alignment of structural tubing for attachment to interconnecting joints. To this end, a split separable joint comprises a hub including a first portion and a second portion. A keyed surface on the first portion is mated to a keyed surface on the second portion. The hub includes a keyed slot extending along the peripheral surface of each portion of the hub. A fastener is provided to retain the first and second hub portions in unitary keyed engagement.

A principal advantage of this embodiment is that tube members of the modular framework section are connected to a keyed portion of a hub at the section periphery. Likewise, the erected framework to which the section is to be attached includes a complimentary keyed hub portion connected to respective tube members. As a result, interconnection of the modular framework section to the erected framework requires only interconnection of the keyed mating hub portions to form a completed hub.

DETAILED DESCRIPTION OF THE PREFERRED EMBODIMENT

Figure 1:
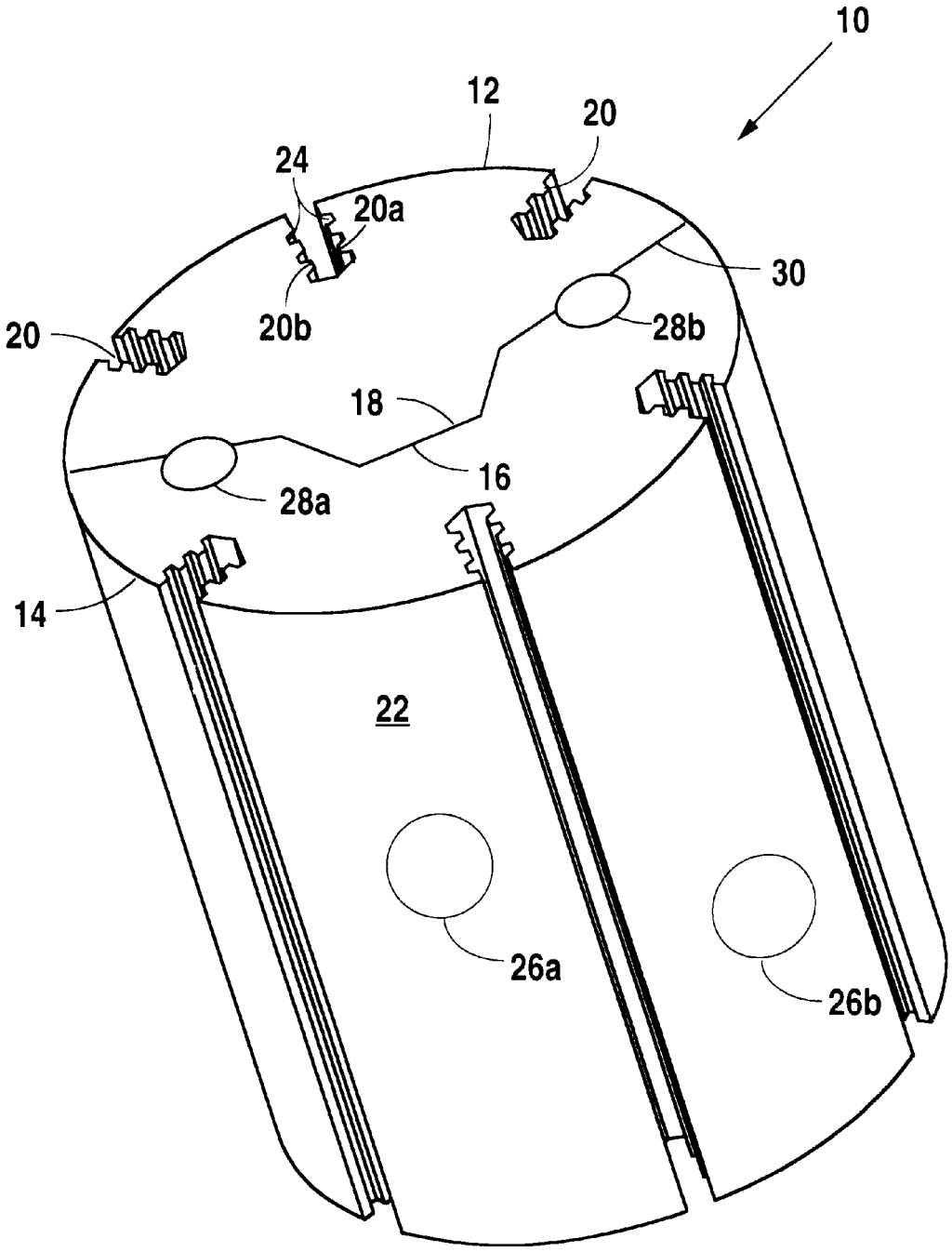
FIG. 1 is an isometric view illustrating an embodiment of a split hub disclosed herein.

Referring now to the drawings, FIG. 1 illustrates a split separable joint comprising a substantially cylindrical hub, generally designated 10, including a first hub portion 12 and a second hub portion 14. A keyed surface 16 on portion 12 is mated to abut a keyed surface 18 on portion 14. This insures that hub portions 12 and 14 will nest together as a unit. A plurality of radially directed slots 20 are formed to extend axially along a peripheral surface 22 of hub 10. Slots 20 are keyed with a plurality of ribs 24 on a pair of opposed slot sides 20*a* and 20*b* which face inwardly or toward each other. It should be noted that hub 10 may be of a shape other than cylindrical. Slots 20 may also be outwardly directed without being radially directed.

Figure 2:
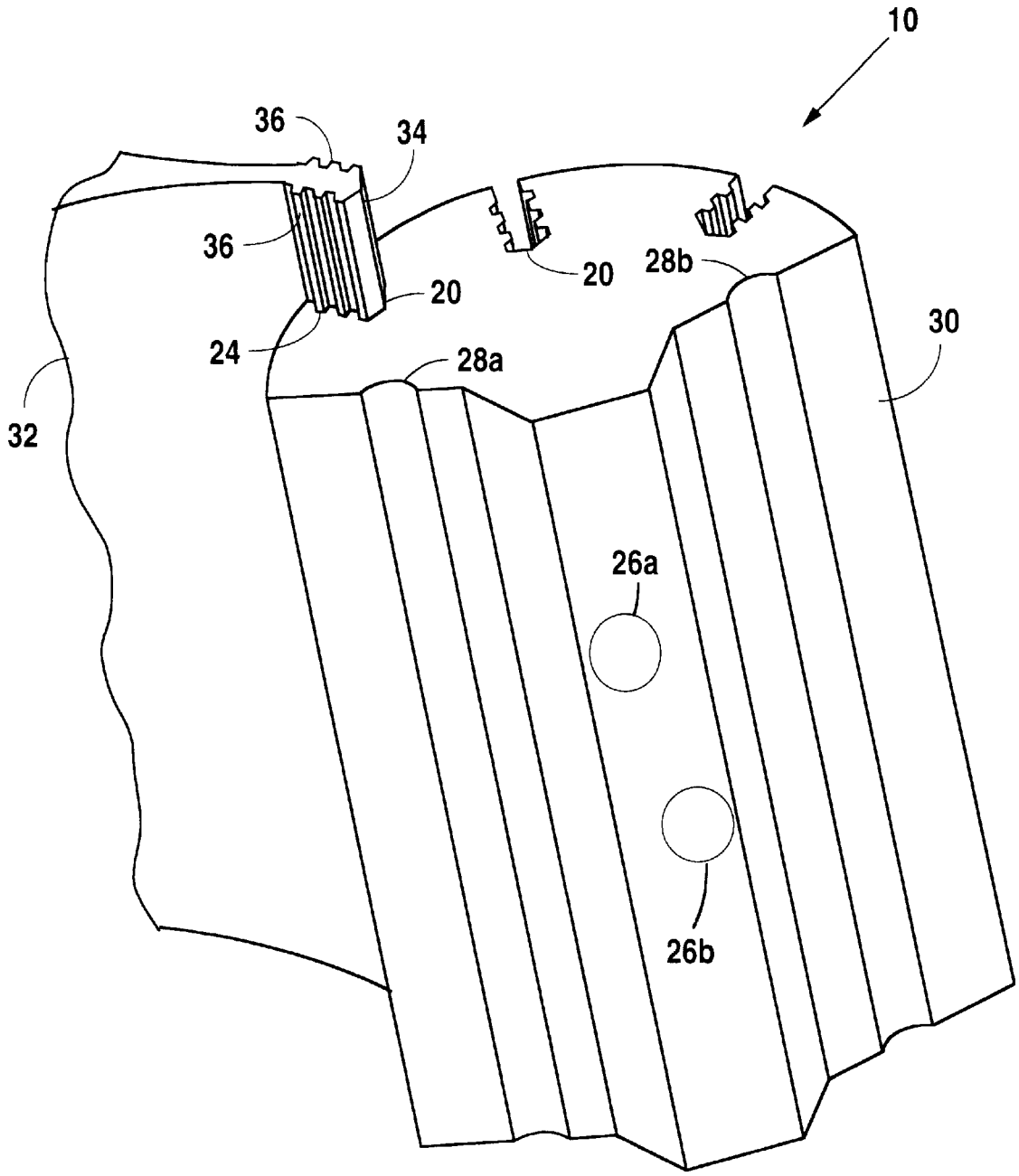
FIG. 2 is an isometric view illustrating an embodiment of a portion of a split hub having a tubular support member connected therewith.
Figure 3:
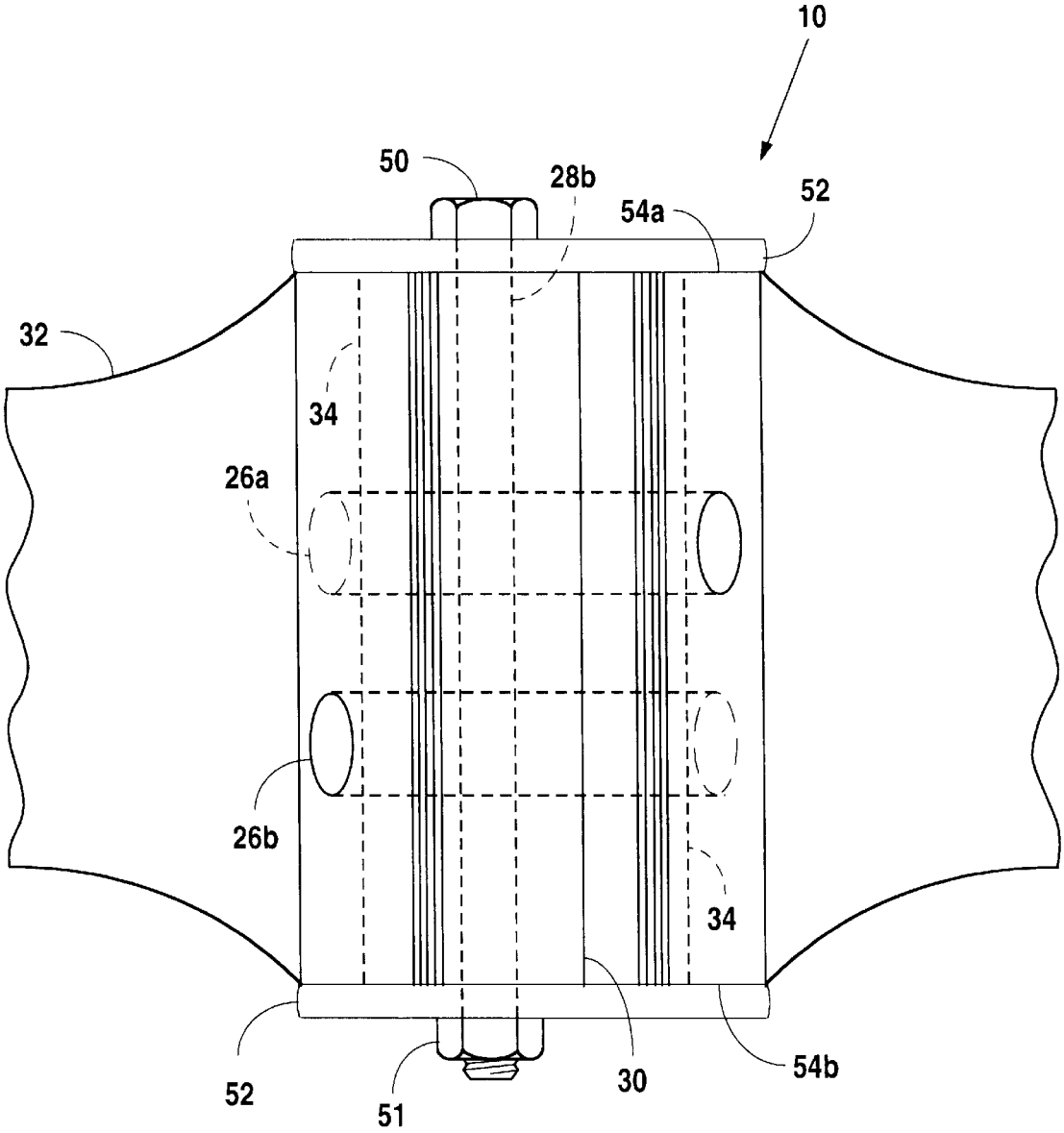
FIG. 3 is a side view illustrating an embodiment of the split hub fully assembled including endplates for retaining tubular support members in their respective slots.

Hub 10 includes a first pair of bores 26*a*, 26*b* formed diametrically therethrough and a second pair of bores 28*a*, 28*b* formed axially therethrough. FIGS. 1, 2 and 3 illustrate that axial bores 28*a* and 28*b* are spaced apart from each other along an interface 30 between keyed surfaces 16 and 18. Interface 30 axially splits hub 10 into portions 12 and 14. Also, it can be seen that a portion of each bore 28*a*, 28*b* is formed in hub portion 12 and a complimentary portion of each bore 28*a*, 28*b* is formed in mating hub portion 14. FIGS. 1–6 illustrate that bores 26*a*, 26*b* are axially spaced apart and are also radially offset so that the axes of bores 26*a*, 26*b* criss-cross within hub 10 as viewed in FIGS. 4–6. Bores 26*a*, 26*b* do not need to be radially offset, but may be axially spaced and aligned, i.e. one directly above or below the other.

Slots 20 are provided for receiving and retaining a plurality of tubular structural members 32, FIGS. 2 and 3 therein. Members 32 may be slidably retained in slots 20. Opposite keyed ends 34, FIG. 2, of members 32 are flattened and have a plurality of outwardly facing ribs 36 crimped into ends 34 for mating engagement with inwardly facing ribs 24 of slots 20.

Figure 6:
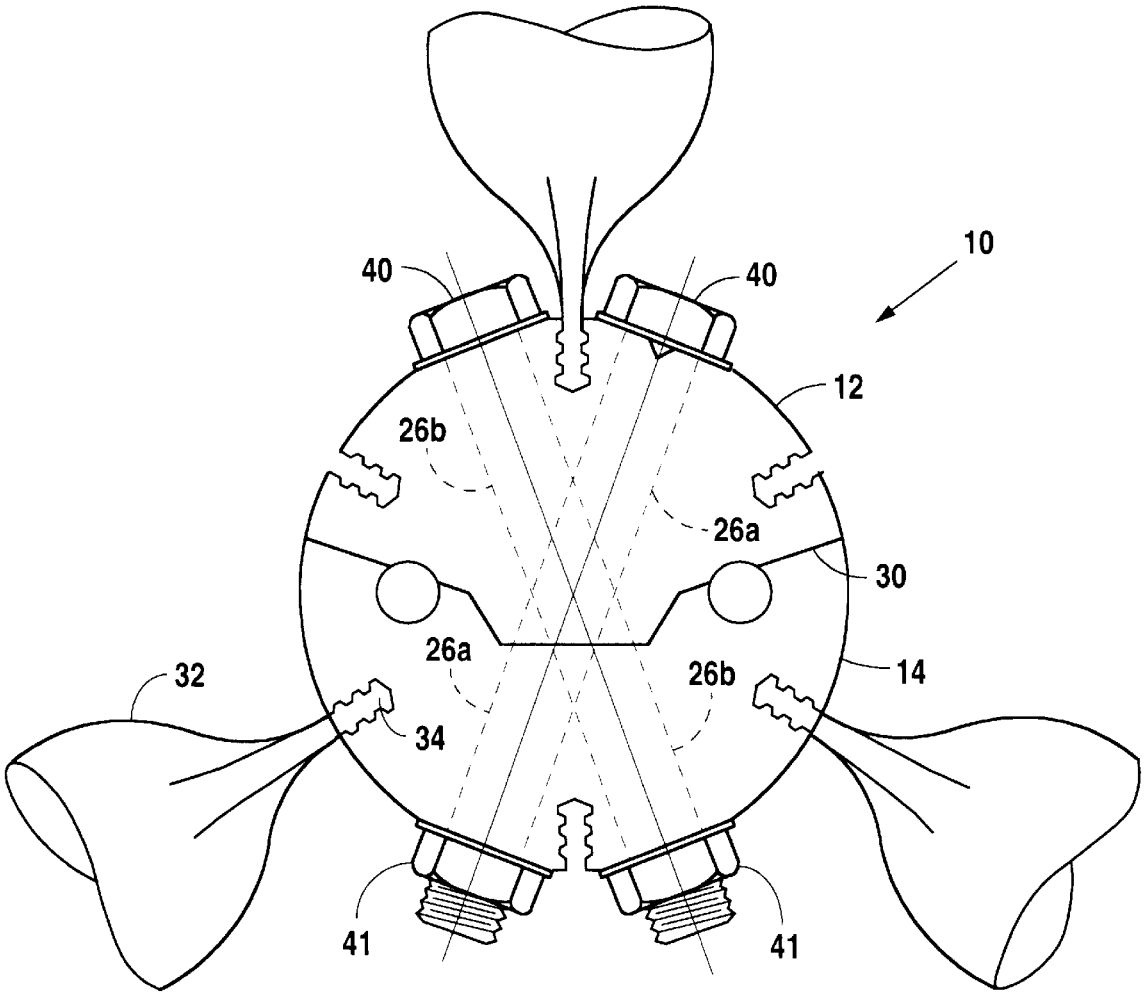
FIG. 6 is a plan view illustrating an embodiment of a split hub assembled and connected by bolts and having tubular support members engaged therewith.

Means such as one or more bolts 40 and nuts 41, FIG. 6, are provided for fastening and retaining first hub portion 12 and second hub portion 14 in unitary keyed engagement. Bolts 40 extend through diametrically extending bores 26*a*, 26*b*. It can be seen from FIGS. 1–6 that each bore 26*a* and 26*b* is partially formed in each hub portion 12, 14 so that when hub portions 12, 14 are mated to form interface 30, the respective portions of bores 26*a*, 26*b* are aligned to receive bolts 40. The criss-cross and axially displaced pattern of bolts 40 transmits moment across the connection and adds stability to the unitary structure of hub 10. However, it should be pointed out that the bolts do not have to be criss-crossed. Also, one bolt may be sufficient or in some cases, more than two bolts may be desired.

In order to retain tubular structural members 32 in hub 10, a pair of bolts 50, and nuts 51, only one of which is shown in FIG. 3, are provided for extending through axially extending bores 28*a*, 28*b*. A pair of endplates or washers 52 are maintained in abutment with opposed ends 54*a*, 54*b* of hub 10 by bolts 50. This captures ends 34 of structural members 32 within slots 20.

Figure 4:
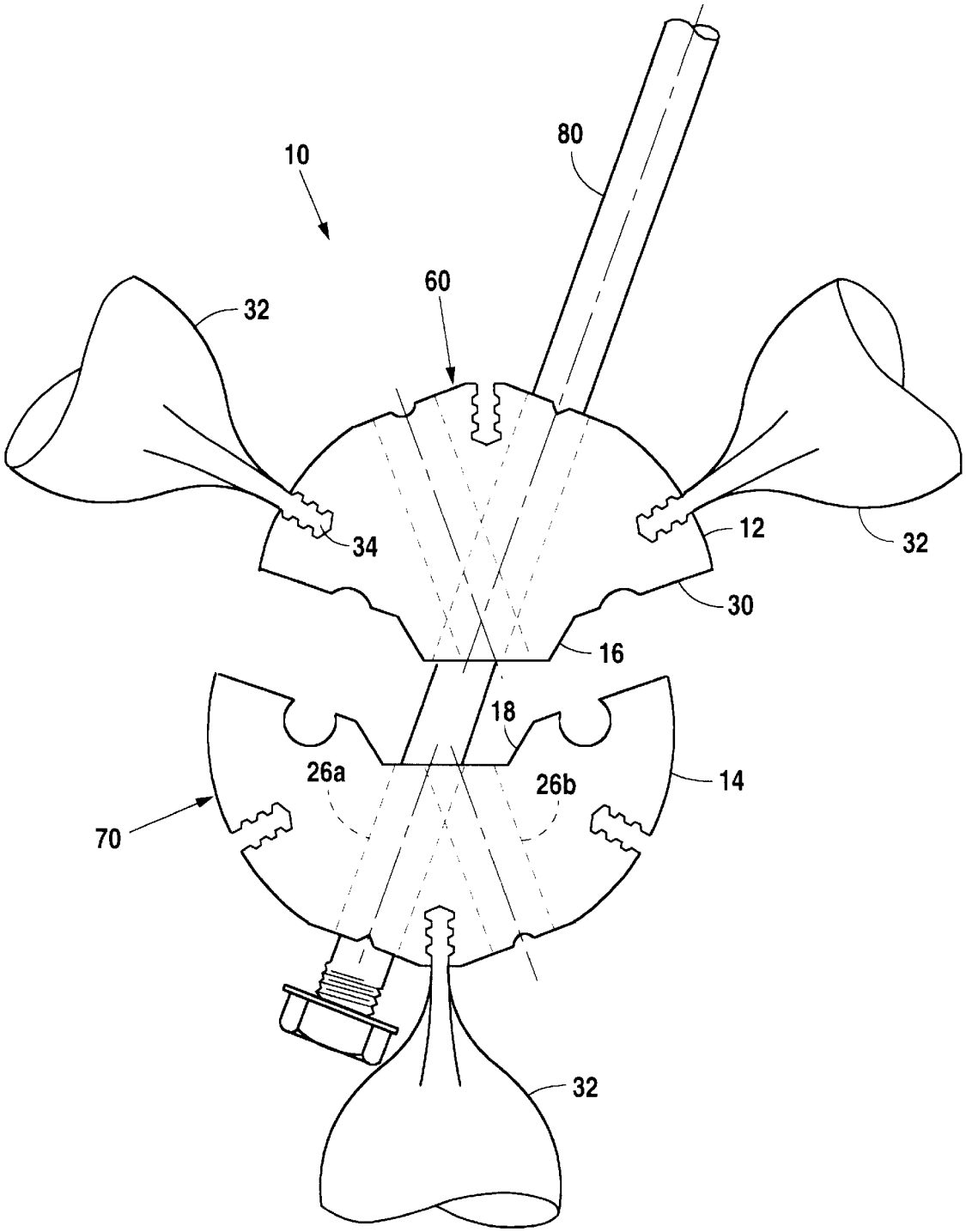
FIG. 4 is a plan view illustrating an embodiment of separated portions of the split hub having an alignment member and tubular support members engaged therewith.
Figure 5:
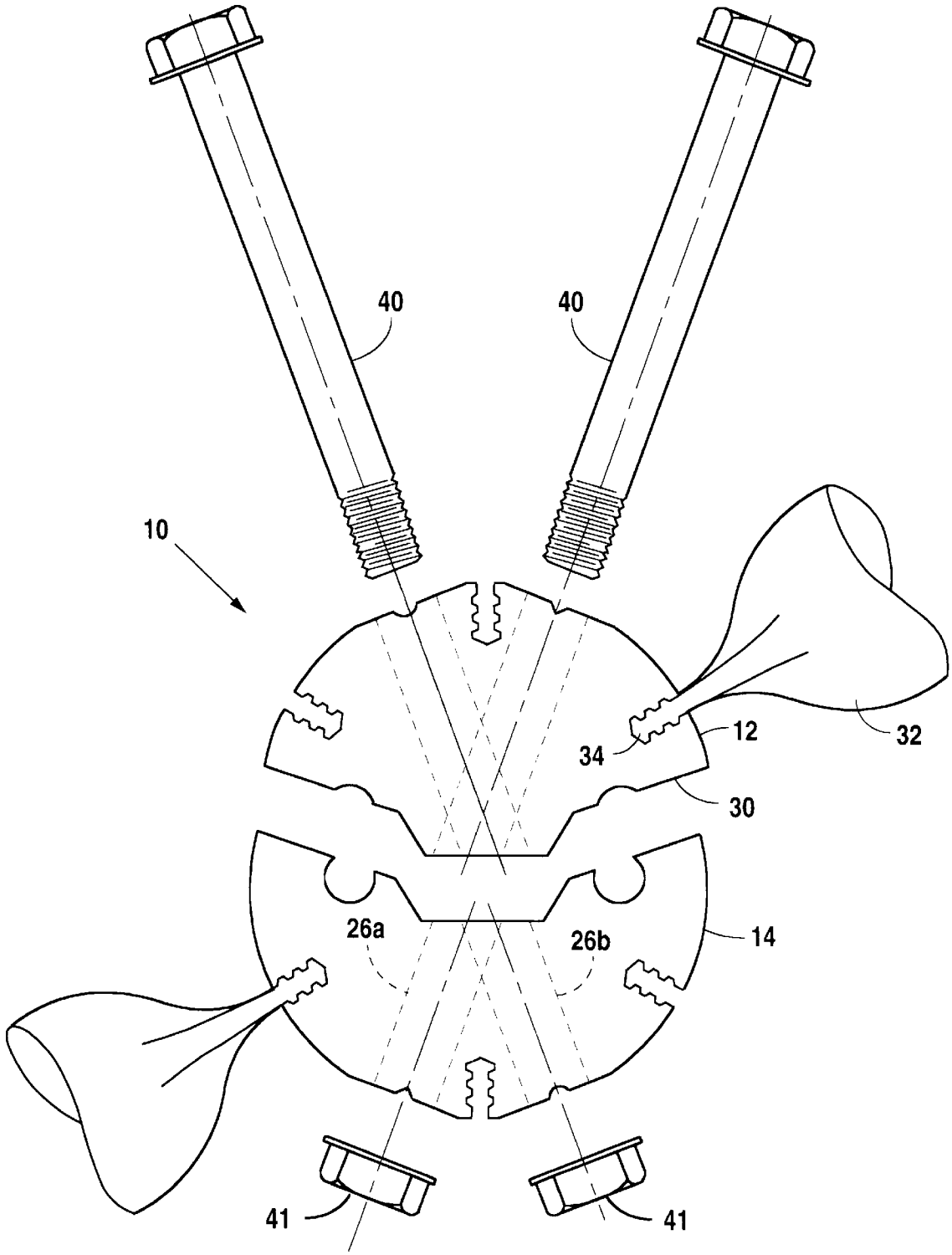
FIG. 5 is a plan view illustrating an embodiment of separated portions of the split hub having tubular support members engaged therewith and attachment bolts positioned for engagement.

In operation, a first section of a frame 60, FIG. 4, includes at least one hub portion 12 connected with at least one structural member 32. A second section of a frame 70, also includes at least one hub portion 14 connected with at least one structural member 32. When it is desired to join the first and second frame sections 60, 70, respectively, hub portion 12 and hub portion 14 may be aligned for mating engagement by using an alignment device such as a steel rod 80, or the like extended through bore 26*a*, for example. The sections 60, 70 can then be drawn together along rod 80 until faces 16 and 18 mate to form interface 30. One of the bolts 40 and nuts 41, illustrated in FIGS. 5 and 6, can then be inserted into bore 26*b* and fastened to retain hub portions 12 and 14 together. Rod 80 can then be removed and another bolt 40 and nut 41 can be inserted to replace rod 80 in bore 26*a* and fastened to stabilize hub portion 12 and 14 together as illustrated in FIG. 6. End plates 52, FIG. 3, can then be retained in place by bolts 50 and nuts 51 to secure the structural members 32 connected to hub 10.

As it can be seen, the principal advantages of these embodiments is that tube members of the framework may be connected to an assembled hub, i.e., a hub which has both portions retained together by bolts in unitary form similar to the previously known one-piece hubs. Significantly, however, the tube members may also be connected to only the first portion of the hub which is then attached to a complimentary or second hub portion which also has tube members connected thereto. As a result, interconnection of modular framework sections with other modular framework sections requires only that the keyed mating hub portions be connected together to form a complete hub.

Although illustrative embodiments have been described, a wide range of modifications, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed is:

1. A split separable joint comprising:

a hub including a first one-piece half portion and a second one-piece half portion;

a keyed surface on the first one-piece half portion and a mating keyed surface on the second one-piece half portion;

a keyed slot formed in a peripheral surface of each one-piece half portion of the hub; and fastener means for retaining the first and second one-piece half portions in unitary keyed engagement, the fastener means including first and second members extending diametrically through the hub and axially spaced from each other.

2. The split separable joint as defined in claim 1 further comprising means for retaining a keyed structural member in the keyed slot.

3. The split separable joint as defined in claim 2 wherein the means for retaining the keyed structural member in the keyed slot includes a fastener extending axially through the hub.

4. The split separable joint as defined in claim 2 wherein the means for retaining the keyed structural member in the keyed slot includes a plurality of spaced apart fasteners extending axially through the hub, the fasteners having an end plate at each opposite end thereof.

5. The split separable joint as defined in claim 1 wherein the hub is substantially cylindrical.

6. The split separable joint as defined in claim 5 wherein the first and second members extend through aligned bores formed in each hub portion.

7. The split separable joint as defined in claim 5 wherein the first and second members are radially offset from each other.

8. The split separable joint as defined in claim 1 wherein the keyed surfaces extend axially through the hub.

9. The split separable joint as defined in claim 1 wherein the first and second members extend through aligned bores formed in each hub portion.

10. The split separable joint as defined in claim 1 wherein the first and second members are radially offset from each other.

11. A split separable joint comprising:

a substantially cylindrical hub including a first one-piece half portion and a second one-piece half portion;

an axially extending keyed surface on the first one-piece half portion and a mating keyed surface on the second one-piece half portion;

means extending diametrically through the hub for retaining the first and second one-piece half portion in unitary keyed engagement; and an axially extending, radially directed, structural member receiving, keyed slot formed in a peripheral surface of each one-piece half portion of the hub and extending the length of the hub.

12. The split separable joint as defined in claim 11 further comprising means for retaining a keyed structural member in the keyed slot.

13. The split separable joint as defined in claim 12 wherein the means for retaining the keyed structural member in the keyed slot includes a fastener extending axially through the hub.

14. The split separable joint as defined in claim 12 wherein the means for retaining the keyed structural member in the keyed slot includes a plurality of spaced apart fasteners extending axially through the hub, the fasteners having an end plate at each opposite end thereof.

15. The split separable joint as defined in claim 11 wherein the means for retaining the hub portions in unitary keyed engagement includes a fastener extending through aligned bores formed in each hub portion.

16. The split separable joint as defined in claim 11 wherein the means for retaining the hub portions in unitary keyed engagement includes a first fastener extending through each hub portion and a second fastener, axially displaced from the first fastener, and extending through each hub portion.

17. The split separable joint as defined in claim 11 wherein the means for retaining the hub portions in unitary keyed engagement includes a first fastener extending through each hub portion and a second fastener, axially displaced from the first fastener, and extending through each hub portion, the first and second fasteners being radially offset from each other.

18. A split separable joint comprising:

a hub including a first one-piece half portion and a second one-piece half portion:

a first structural member connected to the first one-piece half portion;

a second structural member connected to the second one-piece half portion;

a keyed surface on the first one-piece half portion and a mating keyed surface on the second one-piece half portion;

means extending diametrically through aligned bores in each one-piece half portion for engaging the keyed surfaces and retaining the one-piece half portions in unitary engagement; and means extending axially through the hub for retaining the structural member connected to the hub.

19. A method of joining a first space frame section with a second space frame section comprising the steps of:

connecting a first structural member to a first one-piece half portion of a hub having a first keyed surface;

connecting a second structural member to a second one-piece half portion of the hub having a second keyed surface;

drawing the first and second one-piece half portions toward each other;

engaging the first and second keyed surfaces; and securing the first and second one-piece half portions together into a unitary hub.

20. The method as defined in claim 19 further comprising the step of:

securing an end plate to each opposite end of the hub for retaining the first and second structural members connected to the hub.

21. A split separable joint comprising:

a hub including first and second portions;

a keyed surface on the first portion and a mating keyed surface on the second portion;

a keyed slot formed in a peripheral surface of each portion of the hub; and a fastener for retaining the first and second hub portions in unitary keyed engagement including a first member extending diametrically through the hub and a second member, axially displaced from the first member, and extending diametrically through the hub.

22. The split separable joint as defined in claim 21 wherein the first and second members are radially offset from each other.

23. A split separable joint comprising:

a substantially cylindrical hub including a first portion and a second portion;

an axially extending keyed surface on the first portion and a mating keyed surface on the second portion;

means extending diametrically through the hub for retaining the first and second hub portions in unitary keyed engagement including a first fastener extending through each hub portion and a second fastener, axially displaced from the first fastener, and extending through each hub portion; and an axially extending, radially directed, structural member receiving, keyed slot formed in a peripheral surface of each portion of the hub and extending the length of the hub.

24. The split separable joint as defined in claim 23 wherein the first fastener and the second fastener are radially offset from each other.

* * * * *